United States Patent [19]

Rapp

[11] 4,368,506

[45] Jan. 11, 1983

[54] APPARATUS FOR MOUNTING A LUMINAIRE TO A CEILING

[75] Inventor: William J. Rapp, Hayward, Calif.

[73] Assignee: Gardco Manufacturing, Inc., Calif.

[21] Appl. No.: 214,083

[22] Filed: Dec. 8, 1980

[51] Int. Cl.[3] ..... F21S 1/02

[52] U.S. Cl. ..... 362/147; 362/368; 362/404; 362/418; 362/430

[58] Field of Search ..... 362/147, 368, 404, 418, 362/430

[56] References Cited

U.S. PATENT DOCUMENTS 4,199,803 4/1980 Hunt ..... 362/147

4,222,093 9/1980 Garcia et al. ..... 362/147

*Primary Examiner*—Stephen J. Lechert, Jr.

*Attorney, Agent, or Firm*—Robert W. Dilts

[57] ABSTRACT

Novel apparatus for mounting a luminaire to a ceiling is disclosed. A base including a pair of downwardly extending side portions is rigidly mounted to the ceiling. Each side portion has a first post and a second post extending outwardly therefrom. A bracket mounted to the luminaire has a pair of upwardly extending members adapted for mounting to the side portions. Each member has a first slot and a second slot for receiving the first post to rotationally support the member in the second slot in a preliminary mounting position in which appropriate electrical connections are made. The bracket is rotated to receive the second post into a third slot. Support means receive the first and second post from the second and third slots, respectively, to vertically support each member on the respective posts in a final mounting position. The relationship between the slots and support means restrains the first post from being received into the first slot when the bracket is being positioned into the final mounting position.

17 Claims, 8 Drawing Figures

APPARATUS FOR MOUNTING A LUMINAIRE TO A CEILING

DESCRIPTION

1. Technical Field

The present invention relates to hardware mounting apparatus, and more particularly, to an apparatus for mounting a luminaire to a ceiling.

2. Background Art

Known apparatus for mounting a luminaire to a ceiling generally include a base or junction box mounted to the ceiling. A bracket adapted to fit over the junction box is secured to the luminaire. The luminaire is manually supported with the bracket in close proximity to the junction box for electrically connecting electrical conductors from the junction box to the luminaire. The bracket is then placed over the junction box and secured thereto, usually by threaded fasteners.

Luminaires designed for inside use in large areas, such as underground parking garages, are relatively heavy and cumbersome and generally require two people to mount the luminaire. The first person holds the luminaire in position while the other makes the electrical connection and secures the bracket to the base. With the cost of labor rapidly escalating especially for commercial construction workers, the use of known apparatus has become expensive.

It is an object of the present invention to provide an apparatus for mounting the luminaire to the ceiling which requires only one person to position the luminaire and make the electrical connection and secure the luminaire to the ceiling.

SUMMARY OF THE INVENTION

According to the present invention, apparatus for mounting a luminaire to a ceiling is provided comprising a base including a rectangular plate portion rigidly mounted to the ceiling and a pair of side portions extending downwardly from opposite edges of the base. Each side portion has a first post and a second post extending outwardly therefrom and spaced from each other by a selected distance. A bracket including means for mounting a luminaire to the bracket and a pair of upwardly extending members is adapted for positioning over the side portions. Each of the upwardly extending members of the bracket includes a first slot with an open end disposed at an edge of the member and a second slot communicating with the first slot. The first post is received into the first slot and slidingly positioned into the second slot to one end thereof to rotationally support the member and the first post. A third slot with an open end disposed at an edge of the member is spaced from the open end of the first slot to receive the second post while the member is rotationally supported on the first post. Support means receive the second post from the third slot to enable vertical support of the member on each of the first and second post. A relationship exists between the first and second slots and the support means to restrain the first post from being received into the first slot when the second post is being received into the support means.

Other objects, advantages and features of the present invention will become apparent from the following specification when read in conjunction with the drawings.

DETAILED DESCRIPTION OF THE DRAWINGS

Figure 1A:
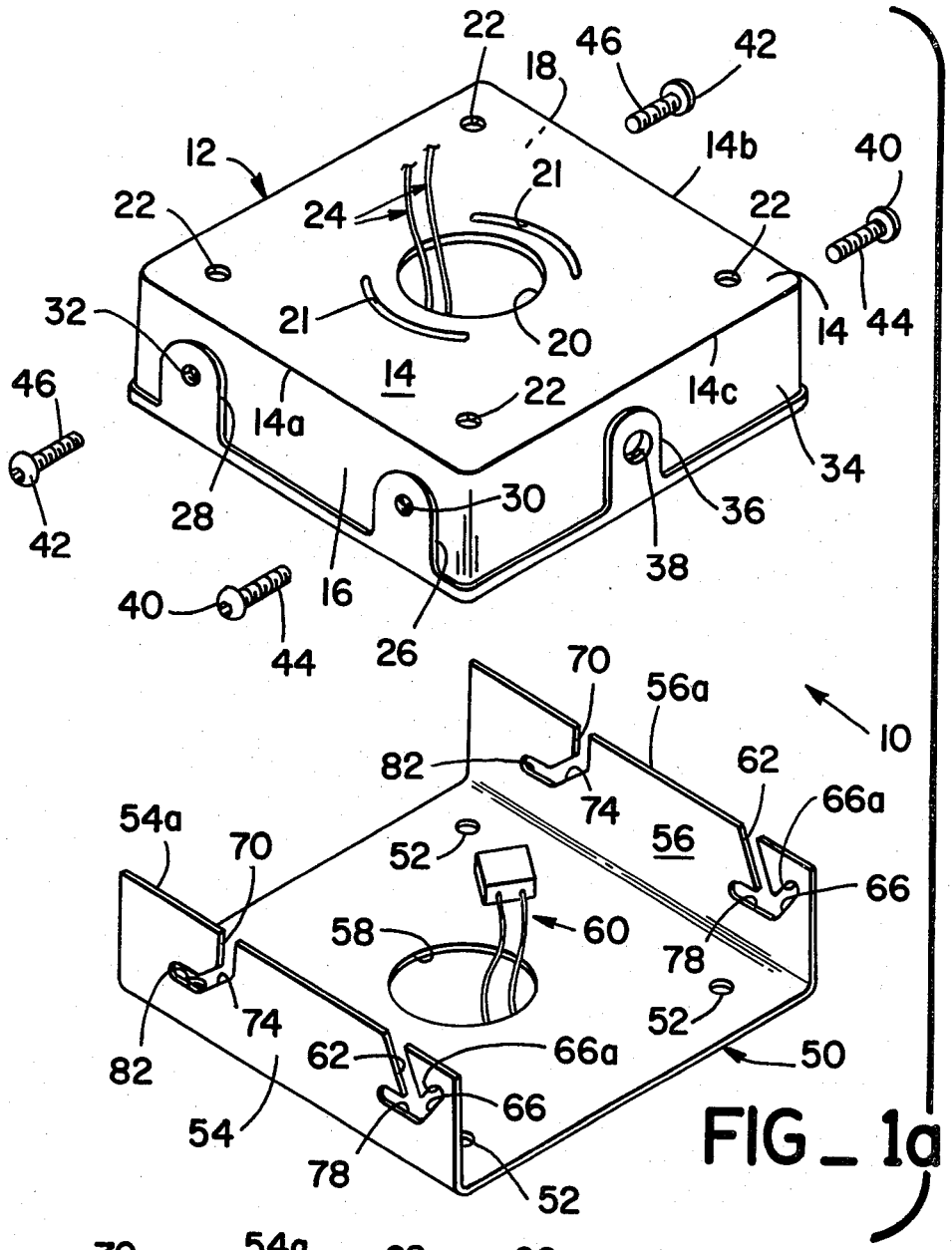
FIG. 1*a* is an exploded perspective view of the mounting apparatus of the present invention.
Figure 1B:
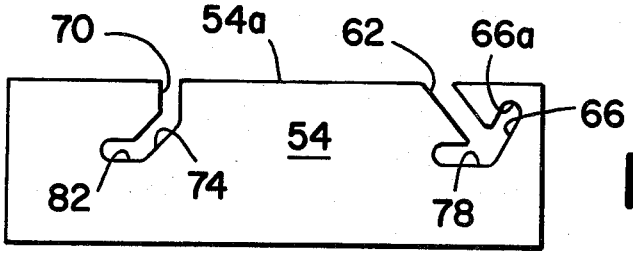
FIG. 1*b* is a side elevational view of a detail of FIG. 1*a;*

With reference to FIG. 1*a* and FIG. 1*b*, there is shown an apparatus 10 for mounting a luminaire to a ceiling. A base 12 includes a rectangular plate portion 14, having opposite edges 14*a* and 14*b*, and a pair of side portions 16 and 18 extending downwardly from opposite edges 14*a* and 14*b*, respectively. Side portions 16 and 18 are mirror images of each other. Plate portion 14 further includes a first aperture 20, a pair of arcuate apertures 21 and a plurality of second apertures 22. Apertures 20, 21 and 22 define means for rigidly mounting base 12 to a ceiling. Base 12 may also include first electrical connector means 24 extending through aperture 20. Each side portion 16 and 18 includes a first boss 26 and a second boss 28. Each boss 26 and 28 includes a threaded opening 30 and 32, respectively, separated by a selected distance and disposed on a selected line along each respective side portion 16 and 18. Base 12 may further include third side portion 34 extending downwardly from edge 14*c* of plate portion 14, and extending between side portions 16 and 18. Third side portion 34 may include a third boss 36 having a threaded opening 38 providing for interconnection with a ceiling mounted conduit through which first electrical connector means 24 may alternately extend.

Apparatus 10 further includes a first fastener 40 having a threaded portion dimensioned to be received within threaded opening 30, and a second fastener 42 having a threaded portion dimensioned to be received within threaded opening 32. Fasteners 40 and 42, and more particularly the threaded portions thereof, are hereinafter referred to as first and second post 44 and 46, respectively.

Completing the structure of apparatus 10 is a bracket 50. Bracket 50 includes means for mounting a luminaire to bracket 50 such as a plurality of apertures 52. A pair of members 54 and 56, being mirror images of each other, extend upwardly from bracket 50, and are spaced to fit to the outside of side portions 16 and 18, respectively of base 12. Bracket 50 further includes an aperture 58 through which extends a second electrical connector means 60 from the luminaire to be mounted. Each member 54 and 56 has an upper edge 54*a* and 56*a*, respectively. Each member 54 and 56 further has a first slot 62 with an open end disposed at edge 54*a* and 56*a*, respectively. A second slot 66 communicates with first slot 62. Each member 54 and 56 further has a third slot 70 with an open end disposed along edge 54*a* and 56*a*, respectively. A fourth slot 74 is parallely aligned with second slot 66 and communicates with third slot 70. A fifth slot 78 and a sixth slot 82 communicates with second slot 66 and fourth slot 74, respectively.

As best shown in FIG. 1*b*, first slot 62 extends downwardly at a selected oblique angle from edge 54*a* (56*a*). Second slot 66 extends upwardly substantially perpendicular from first slot 62. Third slot 70 extends perpendicularly downward from edge 54*a* (56*a*). Second slot 66 has an end 66*a*. The vertical distance between edge 54*a* (56*a*) and end 66*a* is commensurate with the length of third slot 70. Fourth slot 74 is parallel to and of equal length of second slot 66. Fifth slot 78 and sixth slot 82 extend along a horizontal line portion of member 54 (56) from second slot 66 and fourth slot 74, respectively, and are preferably equal in length to each other. The distance between end 66*a* and the center line of third slot 70 is selected to be substantially equal to the selected distance between threaded openings 30 and 32 which receive posts 44 and 46, respectively. Center lines of second slot 66 and fourth slot 74 are also separated by the selected distance.

Figure 2:
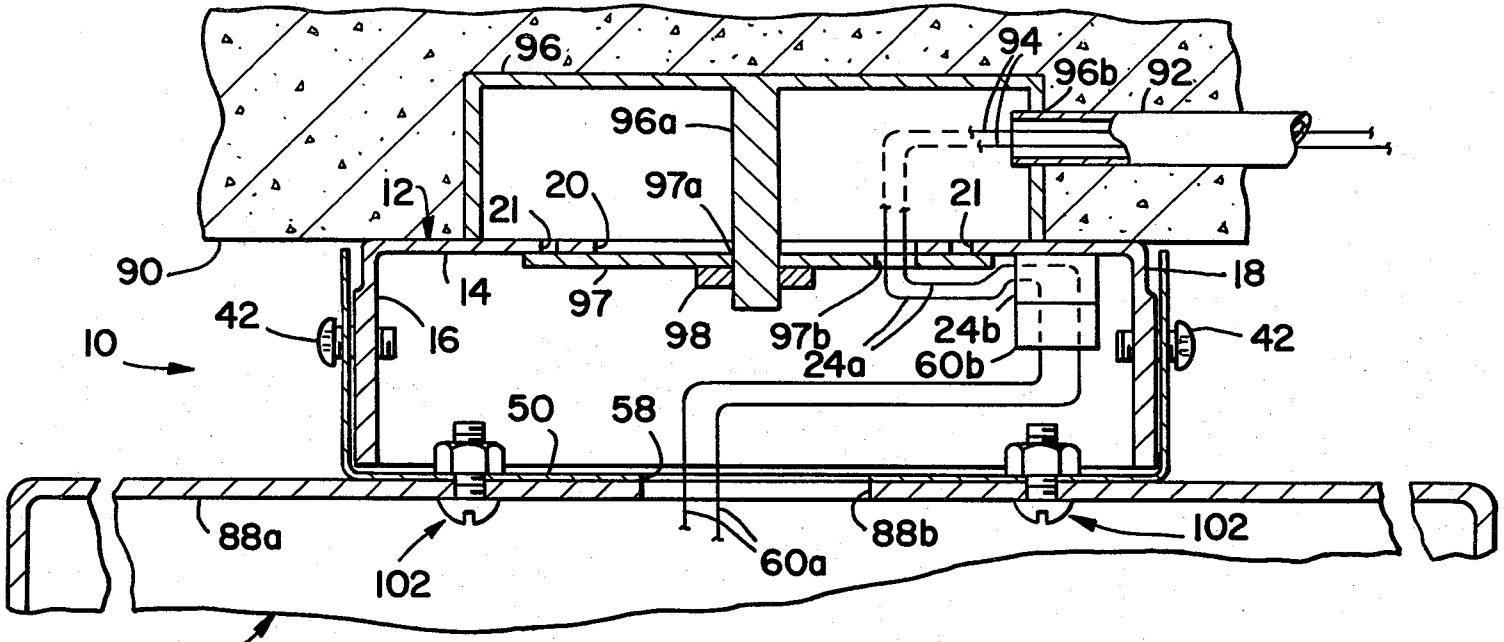
FIG. 2 is a cross-sectional view of a luminaire mounted to a ceiling using the mounting apparatus of the present invention.

FIG. 2 shows mounting apparatus 10 assembled and mounting a luminaire 88 to a ceiling 90. Ceiling 90 may include an electrical conduit 92 having a pair of electrical conductors 94, and a junction box 96 having a downwardly extending threaded stud portion 96*a* and an opening 96*b* which receives conduit 92 in the usual manner. Plate portion 14 is rigidly mounted to ceiling 90 by receiving threaded stud portion 96*a* into first aperture 20. A further plate 97 has a first opening 97*a* dimensioned to receive stud portion 96*a* in linear slidable engagement and a second opening 97*b* spaced from first opening 97*a* to communicate with first aperture 20. A threaded fastener 98, typically a lock nut, secures plate 97 to plate portion 14 and thereby holds base 12 against ceiling 90 and junction box 96. Luminaire 88 having luminaire housing 88*a* and opening 88*b* is secured to bracket 50 by conventional fastener means 102, such as a nut and bolt, through apertures 52. Opening 88*b* communicates with aperture 58. First electrical conductor means 24 includes a pair of electrical conductors 24*a* extending through apertures 97*b* and 22 and a quick disconnect electrical socket 24*b* mounted to plate portion 14. Electrical conductors 24*a* are electrically coupled to electrical conductors 94 in the usual manner. Second electrical connector means 60 includes a pair of electrical conductors 60*a* and a quick disconnect electrical socket 60*b* selected for being coupled to socket 24*b*. Electrical conductor 60*a* extends through aperture 58 and opening 88*b* into luminaire 88 for coupling to a lamp (not shown) within luminaire 88.

Of course, junction box 96 need not have stud portion 96*a*, but may have a pair of inwardly extending flanges having a threaded opening to communicate with a respective one of arcuate apertures 21. Threaded fasteners secure base 12 to ceiling 90 by being received through apertures 21 and received in the threaded openings.

If conduit 92 is exposed along the underside of ceiling 90, junction box 96 need not be used and conduit 92 may be secured directly to base 12 by being received in threaded opening 38 (FIG. 1*a*) in the usual manner. Ceiling 90 may further include a plurality of threaded studs to be received in second apertures 22. Threaded fasteners adapted for being received on the studs would secure base 12 to ceiling 90.

FIGS. 3 through 7 illustrate the sequence of steps to assemble mounting apparatus 10. In order to avoid confusing the principles of the present invention, mounting apparatus 10 is shown in side elevational view omitting the ceiling 90 and luminaire 88. First post 44 and second post 46 are shown in cross-section to illustrate their respective relationship with the hereinabove described slots. The references to side portion 16 and member 54 apply equally to a description of side portion 18 and member 56, respectively. Luminaire 88 is typically dimensioned having sides between 14" and 26" and a height of 7" to 12". Housing 88*a*, may carry a ballast and a reflector which add to the weight of luminaire 88. The advantages of the present invention over the prior art should become apparent from the following description when the weight and size of luminaire 88 is considered therewith.

Figure 3:
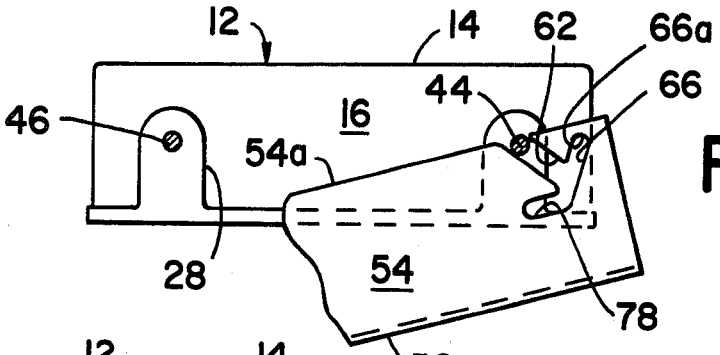
FIGS. 3, 4, 5, 6 and 7 are side elevational views of the mounting apparatus of the present invention illustrating the sequence of assembling the mounting apparatus of the present invention.

FIG. 3 illustrates first slot 62 receiving first post 44 which is slidingly positioned to the other end of first slot 62. Second slot 66 receives first post 44 from first slot 62.

Figure 4:
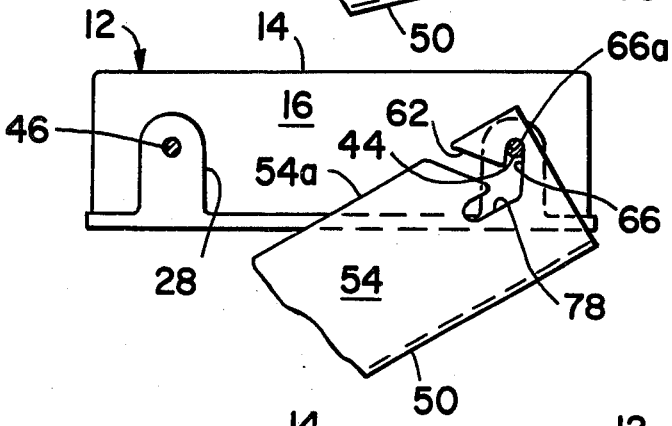

FIG. 4 shows first post 44 having been slidingly positioned to end 66*a* of second slot 66. In this position member 54 is rotationally supported about first post 44 defining the preliminary mounting position wherein bracket 50 may freely hang from each post 44. While in the preliminary mounting position connectors 24*b* and 60*b* (FIG. 2) are manually coupled. It is evident that one person can mount luminaire 88 to the ceiling, freely hanging in the preliminary mounting position, and make the required electrical connection without the aid of a second person.

Figure 5:
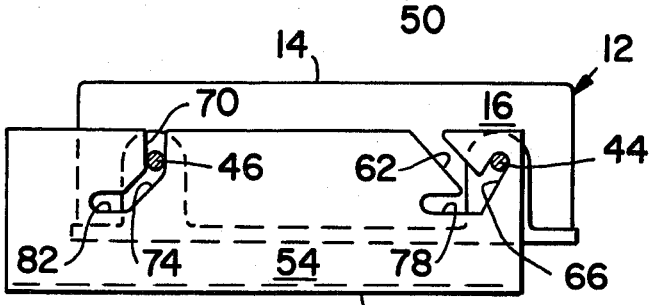

FIG. 5 shows second post 46 being received into third slot 70 and being slidingly positioned to the other end thereof while first slot 44 is in the preliminary mounting position.

Figure 6:
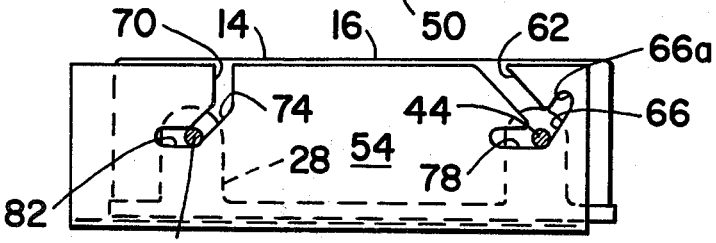

FIG. 6 shows the first and second post 44 and 46 being simultaneously positioned to the other ends of second slot 66 and fourth slot 74, respectively. The hereinabove described spacial relationship existing between first slot 62, second slot 66 and fourth slot 74 restrains first post 44 from being received into first slot 62 during the positioning of each post 44 and 46 along respective second slot 66 and fourth slot 74. Whenever second post 46 has been received into fourth slot 74, first post 44 will never slip free from member 54, avoiding an accidental dropping of luminaire 88. Fourth slot 74, fifth slot 78 and sixth slot 82, in combination, define post support means for receiving first post 44 and second post 46 from second slot 66 and third slot 70, respectively.

Figure 7:
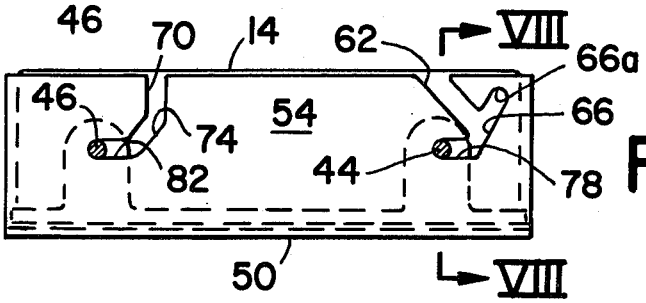

FIG. 7 shows first post 44 and second post 46 having been received into fifth slot 78 and sixth slot 82 and slidingly positioned to the other end thereof, defining the final mounting position. When each post 44 and 46 is in the final mounting position, member 54 is vertically restrained on each post 44 and 46.

Figure 8:
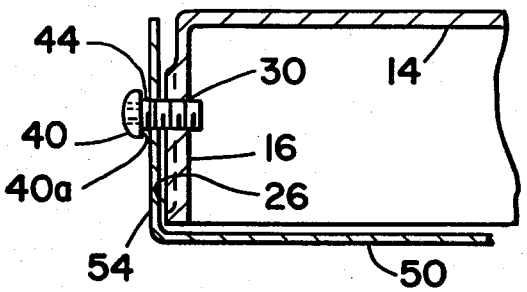
FIG. 8 is a fragmentary cross-sectional view of the mounting apparatus of the present invention taken along line VIII—VIII of FIG. 7.

FIG. 8 shows a cross-sectional view of fastener 40 when post 44 is in the final mounting position. Fastener 40 may be tightened down to secure member 54 to side portion 16 for restraining movement of member 54 horizontally along posts 44 and 46 within fifth slot 78 and sixth slot 82. A head portion 40*a* of fastener 40, and a similar head portion of fastener 42, in combination with the threads of posts 44 and 46, respectively, define means for rigidly attaching member 54 to side portion 16.

In a preferred embodiment of the present invention, base 12 is preferably constructed of cast aluminum. Plate portion 14 is six to seven inches square and side portions 16 and 18 extend downwardly approximately two inches. The selected distance between post 44 and 46 is approximately four inches. Each of the hereinabove slots, in addition to their hereinabove described spacial relationship, are approximately one-half to three-quarter inches long. Fasteners 40 and 42 are $\frac{1}{4}$ inch—$20\times\frac{1}{2}$ inch sems screws. Prior to mounting bracket 50, each fastener 40 and 42 is threaded approximately $\frac{1}{4}$ inch into openings 30 and 32, respectively. Junction box 96 may be a common four inch octagonal outlet box with $\frac{3}{8}$ inch IPS stud. Fastener 98 is a commensurate $\frac{3}{8}$ inch IPS lock nut and lock washer. Luminaire 88 is commercially available from the assignee of the present invention under Model Designation Form 10 adapted for overhead ceiling mounting.

Although the present invention has been described with a great deal of particularity, it is obvious to those skilled in the art to make numerous uses and modifications of the present disclosure without departing from the inventive concepts therein. Accordingly, the present invention is entitled to be construed and limited only by the scope of the appended claims.

What is claimed is:

1. In an apparatus for mounting a luminaire to a ceiling including a base having a rectangular plate portion rigidly mounted to the ceiling and a pair of side portions extending downwardly from opposite edges of the plate portion, each side portion of the base having a first post and a second post extending outwardly therefrom and being separated by a first selected distance, and a bracket having means for mounting the luminaire to the bracket and a pair of upwardly extending members adapted for mounting to the side portions of the base by means of said first and second posts extending outwardly therefrom, the improvement in the bracket wherein each of the upwardly extending members of said bracket comprises:

a first slot having an open end disposed at a selected edge of said member for receiving said first post, said first slot extending at an angle to said selected edge of said member;

a second slot communicating with said first slot for receiving said first post from said first slot, said second slot extending at an angle with respect to said first slot to a closed end for rotationally supporting said member about said first post defining a preliminary mounting position;

a third slot with an open end disposed at said selected edge of the member for receiving said second post and spaced by said first selected distance from said closed end of said second slot, said third slot extending at an angle to said selected edge; and a fourth slot communicating with said third slot for receiving said second post from said third slot and extending at an angle to said third slot to a closed end enabling vertical support of said member on each of said first and second posts in a final mounting position said first and second slots having a spacial relationship to said third slot and said fourth slot preventing said first post from being received into said first slot from said second slot when said second post is received in said third slot or said fourth slot.

2. An apparatus as in claim 1 in which said first slot extends obliquely from said selected edge, said selected edge being an upper edge of said member.

3. An apparatus as in claim 2 in which said second slot extends substantially perpendicularly and upwardly from said first slot, said first slot being disposed intermediate said second slot and said third slot, said one end of said second slot being spaced from said upper edge by a second selected distance.

4. An apparatus as in claim 3 in which said third slot extends substantially perpendicularly from said selected edge, said third slot having a length commensurate with said second selected distance.

5. An apparatus as in claim 4 including a fifth slot having one end communicating with both said first slot and said second slot for receiving said first post from said first and second slots, and a sixth slot communicating with said fourth slot for receiving said second post from said fourth slot.

6. An apparatus as in claim 5 in which said fourth slot is disposed parallel to said second slot, said fourth slot having a length commensurate with said second slot.

7. An apparatus as in claim 6 in which said fifth slot and said sixth slot are spaced from each other disposed along a common line portion of said member.

8. An apparatus for mounting a luminaire to a ceiling, comprising:

a base including a rectangular plate portion having means for rigidly mounting said base to the ceiling, and a pair of side portions extending downwardly from opposite edges of said plate portion;

a pair of first posts, each of said pair of first posts extending outwardly from a different one of said side portions, and a pair of second posts, each of said pair of second posts extending outwardly from a different one of said side portions, each first post on a given side portion being separated from the second post on said given side portion by a first selected distance; and a bracket including means for mounting the luminaire to said bracket and a pair of upwardly extending members, each of said pair of upwardly extending members having a first slot with an open end disposed at a selected edge of said member for receiving said first post, said first slot extending at an angle to said selected edge of said member, a second slot communicating with said first slot for receiving said first post from said first slot, said second slot extending at an angle with respect to said first slot to a closed end for rotationally supporting said member about said first post defining a preliminary mounting postion, a third slot extending at and angle with respect to said selected edge with an open end disposed at said selected edge of said member and spaced by said first selected distance from said closed end of said second slot for receiving said second post when said first post is in said preliminary mounting position, and a fourth slot communicating with said third slot for receiving said second post from said third slot and extending at an angle to said third slot to a closed end enabling vertical support of said member on each of said first and second posts defining a final mounting position, said first and second slots having a spacial relationship to said third and fourth slots preventing said first post from being received into said first slot when said second post is received in said third slot or said fourth slot.

9. An apparatus as in claim 8 in which said first slot extends obliquely from said selected edge, said selected edge being an upper edge of said member.

10. An apparatus as in claim 9 in which said second slot extends substantially perpendicularly and upwardly from said first slot, said first slot being disposed intermediate said second slot and said third slot, said one end of said second slot being spaced from said upper edge by a second selected distance.

11. An apparatus as in claim 10 in which said third slot extends substantially perpendicularly from said selected edge, said third slot having a length commensurate with said second selected distance.

12. An apparatus as in claim 11 including a fifth slot having an open end communicating with both said first slot and said second slot for receiving said first post from said first and second slots, and a sixth slot communicating with said fourth slot for receiving said second post from said fourth slot.

13. An apparatus as in claim 12 in which said fourth slot is disposed parallel to said second slot, said fourth slot having a length commensurate with said second slot.

14. An apparatus as in claim 13 in which said fifth slot and said sixth slot are spaced from each other disposed along a common line portion of said member.

15. An apparatus as in claim 8 in which said first and second posts extend in a common plane, each of said first posts being disposed along a first line in said common plane, and each of said second posts being disposed along a second line in said common plane parallel to said first line.

16. An apparatus as in claim 8 in which each of said posts includes means for rigidly attaching each of said members to said side portions.

17. An apparatus as in claim 8 in which said base further includes first electrical connector means for coupling to second electrical connector means associated with the luminaire when said bracket is in the primary mounting position.

* * * * *